US007775830B2

(12) United States Patent
Huang

(10) Patent No.: US 7,775,830 B2
(45) Date of Patent: Aug. 17, 2010

(54) CONNECTOR WITH METAL FIXING ELEMENT AND ELECTRONIC DEVICE HAVING THE SAME

(75) Inventor: Pai-Ching Huang, Taipei (TW)

(73) Assignee: ASUSTeK Computer Inc., Taipei (TW)

( * ) Notice: Subject to any disclaimer, the term of this patent is extended or adjusted under 35 U.S.C. 154(b) by 0 days.

(21) Appl. No.: 12/358,243

(22) Filed: Jan. 23, 2009

(65) Prior Publication Data

US 2009/0197473 A1 Aug. 6, 2009

(30) Foreign Application Priority Data

Feb. 5, 2008 (TW) ..... 97104610 A

(51) Int. Cl.
*H01R 13/60* (2006.01)
*H01R 13/66* (2006.01)

(52) U.S. Cl. ..... 439/567; 439/571

(58) Field of Classification Search ..... 439/567, 439/571

See application file for complete search history.

(56) References Cited

U.S. PATENT DOCUMENTS 4,842,554 A * 6/1989 Cosmos et al. ..... 439/607.17
5,037,330 A * 8/1991 Fulponi et al. ..... 439/607.23
5,044,988 A * 9/1991 Hirayama ..... 439/571
5,161,999 A * 11/1992 Broschard et al. ..... 439/567
6,152,765 A * 11/2000 Tang et al. ..... 439/567
6,558,205 B1 * 5/2003 Shi et al. ..... 439/676
6,648,682 B1 * 11/2003 Wu ..... 439/567
7,241,174 B2 * 7/2007 Tsai ..... 439/607.25
7,510,431 B2 * 3/2009 Zhu et al. ..... 439/567

* cited by examiner

*Primary Examiner*—Hae Moon Hyeon
(74) *Attorney, Agent, or Firm*—Jianq Chyun IP Office

(57) ABSTRACT

A connector including an insulating housing, a plurality of signal terminals, and at least a metal fixing element is provided. The signal terminals are disposed in the insulating housing, wherein a portion of each signal terminal is protruding out from the insulating housing. The metal fixing element has an inserting part and a fixing part connected to the inserting part. The inserting part is inserted in the insulating housing, and the fixing part is protruding out from the insulating housing at a same side with the signal terminals. The connector is suitable for welding on a circuit board through the fixing part.

10 Claims, 7 Drawing Sheets

CONNECTOR WITH METAL FIXING ELEMENT AND ELECTRONIC DEVICE HAVING THE SAME

CROSS-REFERENCE TO RELATED APPLICATION

This application claims the priority benefit of Taiwan application serial no. 97104610, filed Feb. 5, 2008. The entirety of the above-mentioned patent application is hereby incorporated by reference herein and made a part of specification.

BACKGROUND OF THE INVENTION

1. Field of the Invention

The present invention relates to a connector. More particularly, the present invention relates to a connector and a circuit board using the same.

2. Description of Related Art

With wide use of personal computers and development of multimedia devices, to expand functions of the personal computer, a plurality of connectors can be disposed on a host of the personal computer for simultaneous utilizing the personal computer and the multimedia device.

FIG. 1A is a schematic diagram illustrating a conventional connector and a circuit board. FIG. 1B is a schematic diagram of the connector of FIG. 1A. Referring to FIG. 1A and FIG. 1B, a connector 100 is inserted on a circuit board 200. The connector 100 includes an insulating housing 110, and two connecting sockets 112 and 114 are disposed on the insulating housing 110, wherein types of the connecting socket 112 and the connecting socket 114 are different. The connecting socket 112 is suitable for accommodating a network plug, a telephone plug or a fiber plug, while the connecting socket 114 is suitable for accommodating a coaxial connector. Moreover, a portion of each signal terminal 120 disposed within the connecting sockets 112 and 114 is protruding out from the insulating housing 110. When the connector 100 is inserted onto the circuit 200, the network plug, the telephone plug, the fiber plug or the coaxial connector can be electrically connected to the signal terminals 120, so that electrical signals can be transmitted between the plugs and the circuit board 200 via the connector 100.

Moreover, to smoothly insert the connector 100 onto the circuit board 200, the insulating housing 110 of the connector 100 has a plurality of plastic fixing poles 116, and a plurality of corresponding through holes 210 are disposed on the circuit board 200. The plastic fixing poles 116 are correspondingly inserted into the through holes 210 for stably connecting the connector 100 and the circuit board 200.

However, since material of the insulating housing 110 is plastic, and based on characteristics of the plastic, the plastic fixing pole 116 has a certain degree of elasticity and can be deformed. When the circuit board 200 is impacted by external forces during transportation or a drop test, the signal terminals 120 of the connector 100 inserted on the circuit board 200 can be broken, and the plastic fixing poles 116 can be shifted from the through holes due to elastic deformation thereof, which may result in a fact that the connector 100 is floated and leaned on the circuit board 200 as that shown in FIG. 1C.

Therefore, the signals cannot be transmitted between the connector 110 and the circuit board 200, and the whole device cannot be normally utilized.

SUMMARY OF THE INVENTION

The present invention is directed to a connector, which can be stably fixed on a circuit board.

The present invention is directed to an electronic device, in which a connector is not liable to be floated and leaned on a circuit board.

The present invention provides a connector including an insulating housing, a plurality of signal terminals, and at least a metal fixing element. The signal terminals are disposed in the insulating housing, wherein a portion of each signal terminal is protruding out from the insulating housing. The metal fixing element has an inserting part and a first fixing part connected to the inserting part. The inserting part is inserted in the insulating housing, and the first fixing part is protruding out from the insulating housing at a same side with the signal terminals, and the first fixing part is suitable for being welded on a circuit board.

In an embodiment of the present invention, the metal fixing element is formed by bending a resilient plate.

In an embodiment of the present invention, an edge of the first fixing part has a shape of a column or a harpoon.

In an embodiment of the present invention, the insulating housing further has at least a second fixing part, and the second fixing part is arranged on the insulating housing at a same surface with that of the first fixing part of the metal fixing element.

The present invention provides an electronic device including a circuit board and a connector. A plurality of signal terminal through holes and a plurality of fixing through holes are disposed on an edge of the circuit board. The connector is disposed on the circuit board, wherein the connector includes an insulating housing, a plurality of signal terminals, and at least a metal fixing element. The signal terminals are disposed in the insulating housing, wherein a portion of each signal terminal is protruding out from the insulating housing and is inserted in the corresponding signal terminal through hole. The metal fixing element has an inserting part and a first fixing part connected to the inserting part. The inserting part is inserted in the insulating housing, and the first fixing part is protruding out from the insulating housing at a same side with the signal terminals, and is correspondingly inserted in at least one of the fixing through holes for wedding the first fixing part on the circuit board.

In an embodiment of the present invention, the metal fixing element is formed by bending a resilient plate.

In an embodiment of the present invention, an edge of the first fixing part has a shape of a column or a harpoon.

In an embodiment of the present invention, the first fixing part is located on a side of the insulating housing adjacent to an edge of the circuit board.

In an embodiment of the present invention, the insulating housing further has at least a second fixing part, and the second fixing part is arranged on the insulating housing at a same surface with that of the first fixing part of the metal fixing element.

In an embodiment of the present invention, there has a plurality of the second fixing parts, the first fixing part is located at a side of the insulating housing adjacent to the edge of the circuit board, and the second fixing parts are located at a side of the insulating housing departing from the edge of the circuit board.

In an embodiment of the present invention, material of the metal fixing element includes aluminum ferroalloy, or tin alloy.

In the electronic device and the connector of the present invention, the fixing part of the metal fixing element of the connector is inserted in the fixing through hole of the circuit board, so that the fixing part of the metal fixing element can be welded on the circuit board for stably fixing the connector on the circuit board. Therefore, even the electronic device is impacted, the connector is not liable to be floated and leaned on the circuit board, so that utilization abnormality of the connector can be avoided. Therefore, production yield and lifespan of the electronic device can be improved.

In order to make the aforementioned and other objects, features and advantages of the present invention comprehensible, a preferred embodiment accompanied with figures is described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

First Embodiment

Figure 1A:
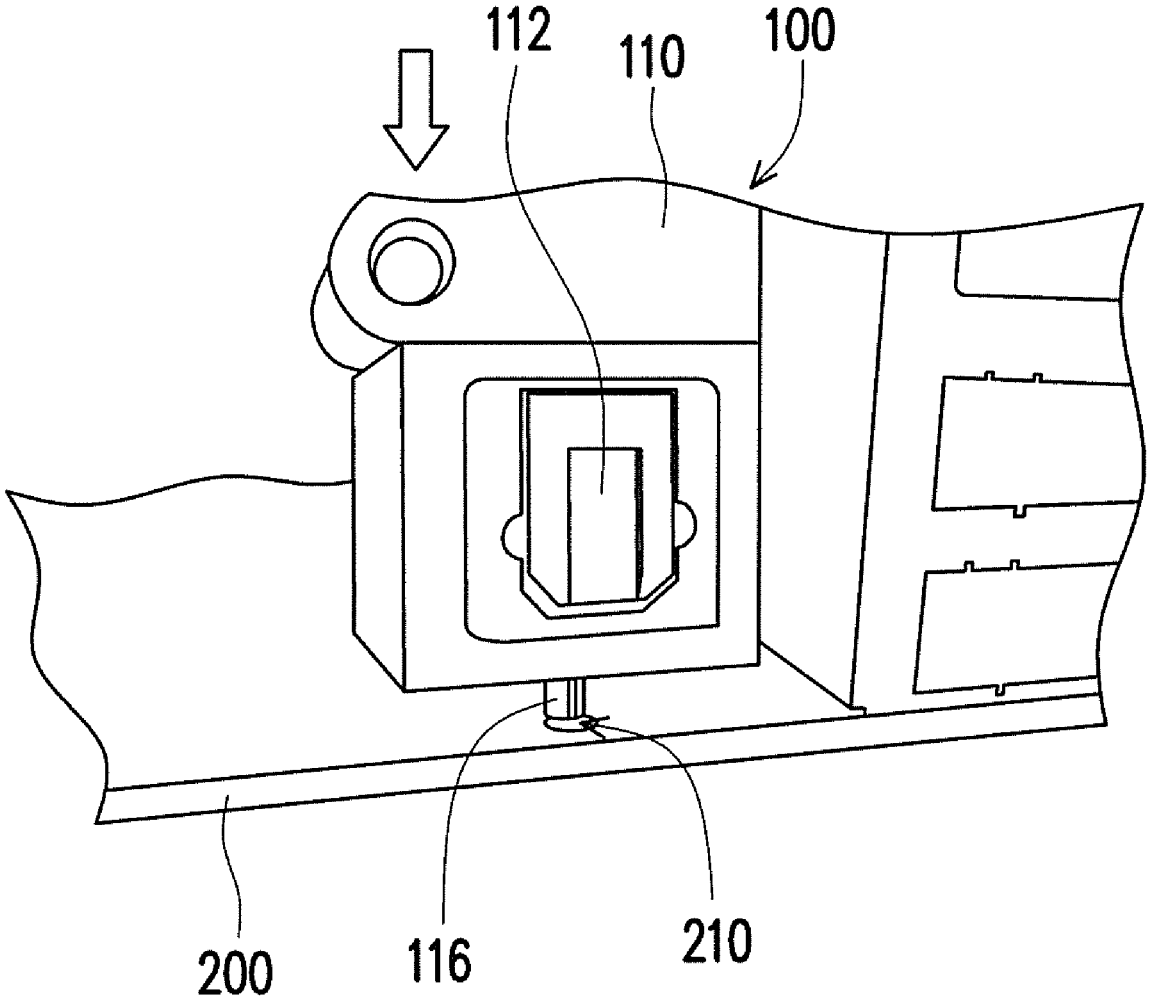
FIG. 1A(PRIOR ART)
FIG. 1A is a schematic diagram illustrating a conventional connector and a circuit board.
Figure 1B:
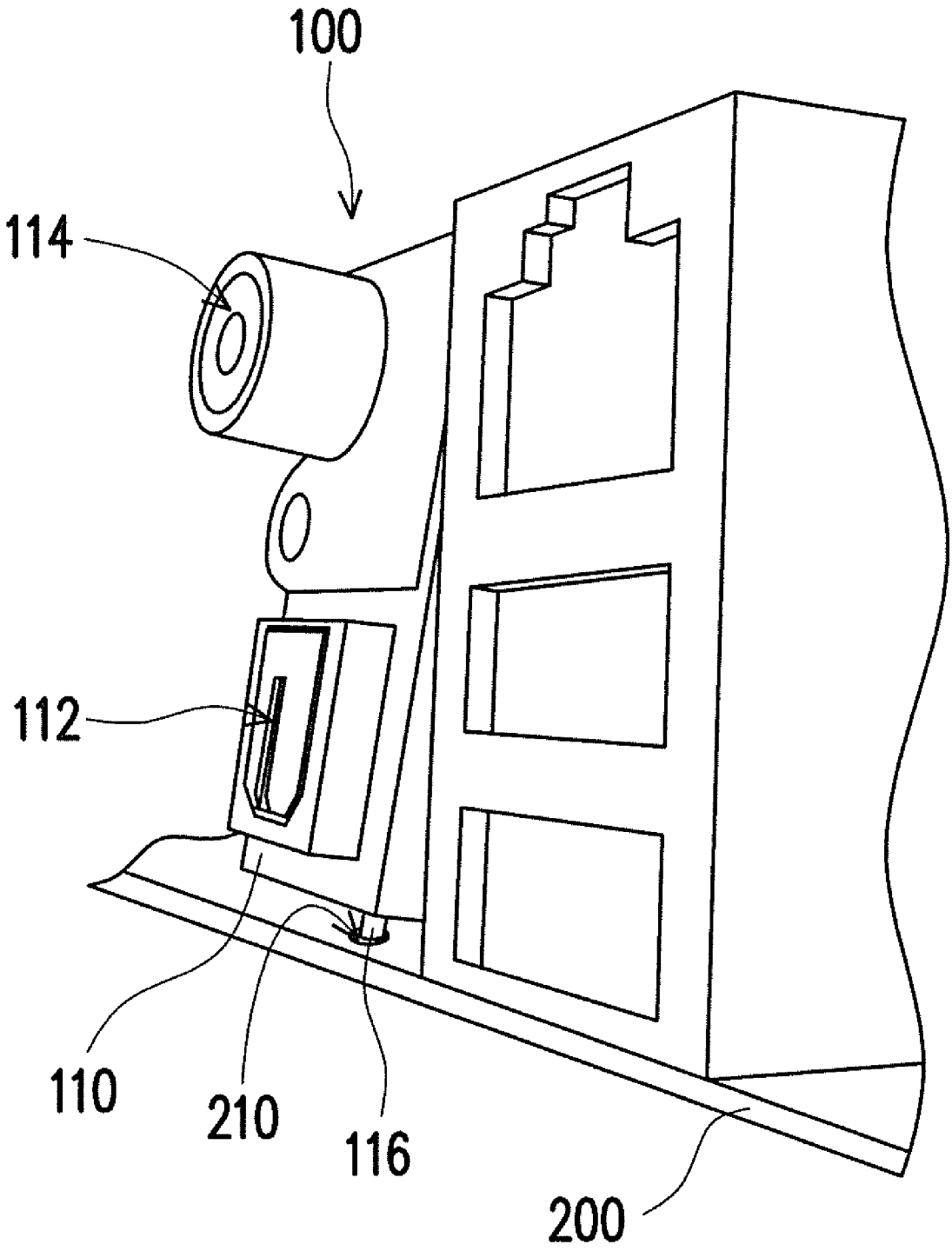
FIG. 1B(PRIOR ART)
FIG. 1B is a schematic diagram of a connector of FIG. 1A.
Figure 1C:
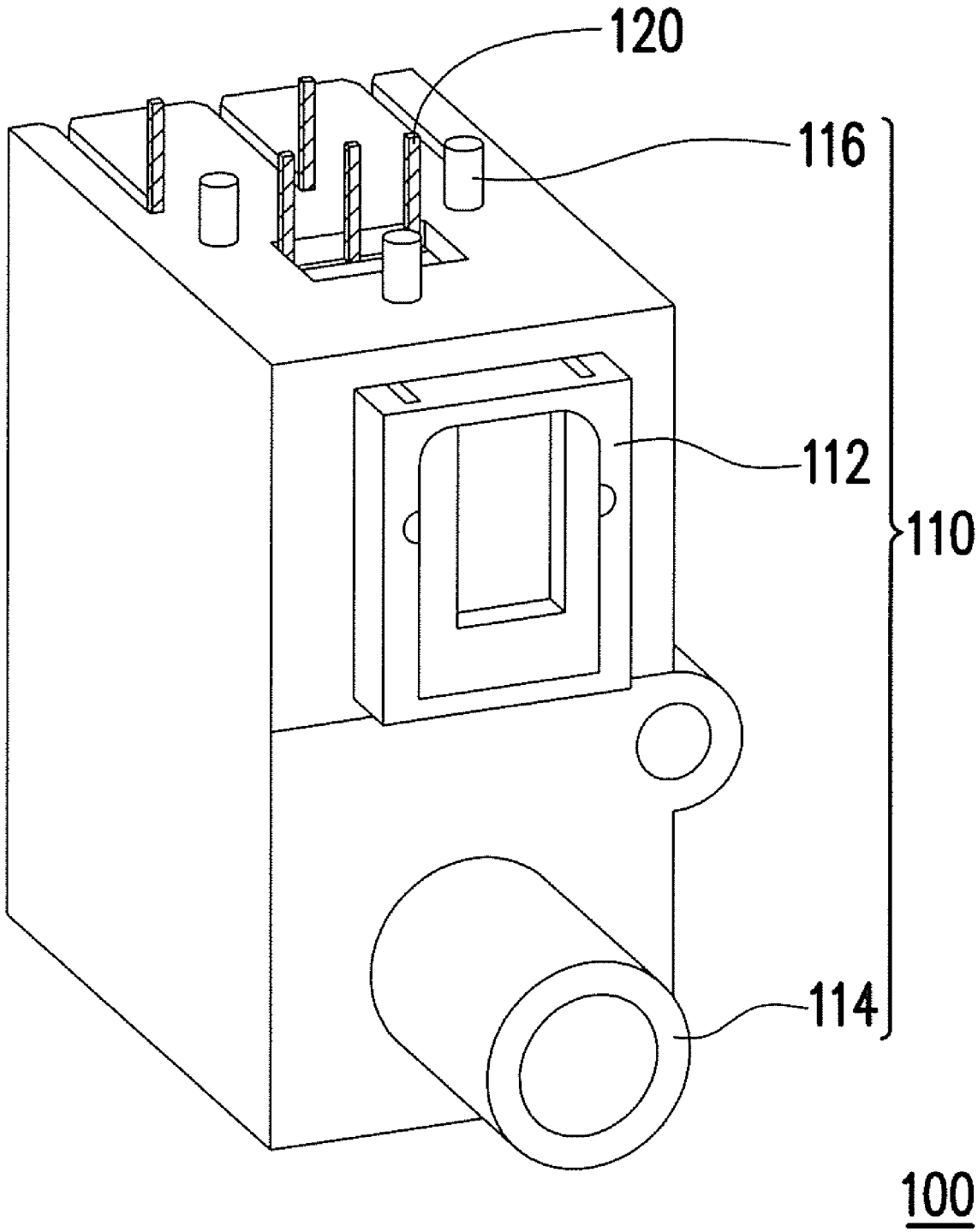
FIG. 1C(PRIOR ART)
FIG. 1C is a schematic diagram illustrating a situation that a connector is floated and leaned on a circuit board of FIG. 1
Figure 2:
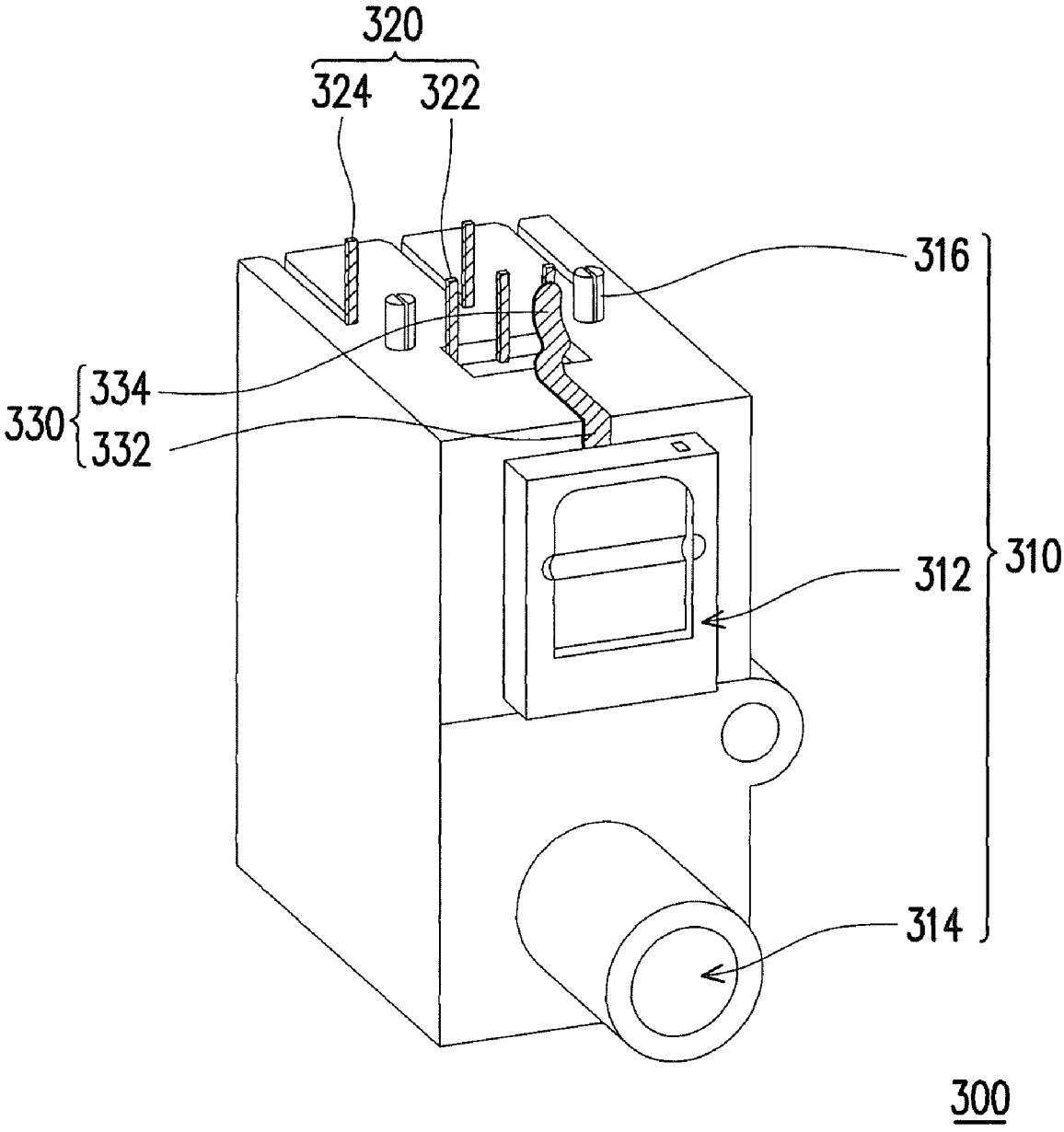
FIG. 2 is a schematic diagram illustrating a connector according to a first embodiment of the present invention.

FIG. 2 is a schematic diagram illustrating a connector according to a first embodiment of the present invention. Referring to FIG. 2, the connector 300 includes an insulating housing 310, a plurality of signal terminals 320 and at least a metal fixing element 330. Material of the insulating housing 310 is plastic, and the insulating housing 310 of the connector 300 of FIG. 2 has two connecting sockets 312 and 314, wherein the connecting socket 312 can be a RJ-45 local area network (LAN) port or a RJ-11 modem port, etc., which is suitable for accommodating a fiber signal line, a network signal line or a telephone signal line, and the connecting socket 314 can be a S-video output port, which is suitable for accommodating a coaxial signal line. Those skilled in the art can change types and amounts of the connecting sockets of the insulating housing of the connector according to actual requirements. In other words, number of the connecting socket of the insulating housing of the connector can be one or more, and the types of the connecting socket are not limited to the aforementioned ports, which can also be a D-sub video output port, a universal serial bus (USB) or other ports.

The signal terminals 320 are disposed in the insulating housing 310, and a portion of each signal terminal 320 is protruding out from the insulating housing 310. The signal terminals 320 of the present embodiment correspond to two connecting sockets 312 and 314 and are divided into a first signal terminal 322 and a second signal terminal 324, wherein the fiber signal line, the network signal line or the telephone signal line is correspondingly accommodated into the connecting socket 312 and is electrically connected to the first signal terminal 322, and the coaxial signal line accommodated into the connecting socket 314 is electrically connected to the second signal terminal 324.

The metal fixing element 330 has an inserting part 332 and a first fixing part 334, wherein the inserting part 332 is inserted into the insulating housing 310. The first fixing part 334 is connected to the inserting part 332, and is protruding out from the insulating housing 310 at the same side with the signal terminals 320. As shown in FIG. 2, the metal fixing element 330 of the present embodiment is formed by bending a metal elastic plate, and an edge of the first fixing part 334 has a shape of a column or a harpoon.

Moreover, the insulating housing 310 further has a plurality of second fixing parts 316, and an edge of the second fixing part 316 also has a shape of a column or a harpoon, which can be designed according to actual requirements. To save a usage amount of the material, a number of the second fixing parts 316 of the insulating housing 310 is set to 2, and the material of the second fixing part 316 can be the same as that of the insulating housing or the metal fixing element.

Figure 3:
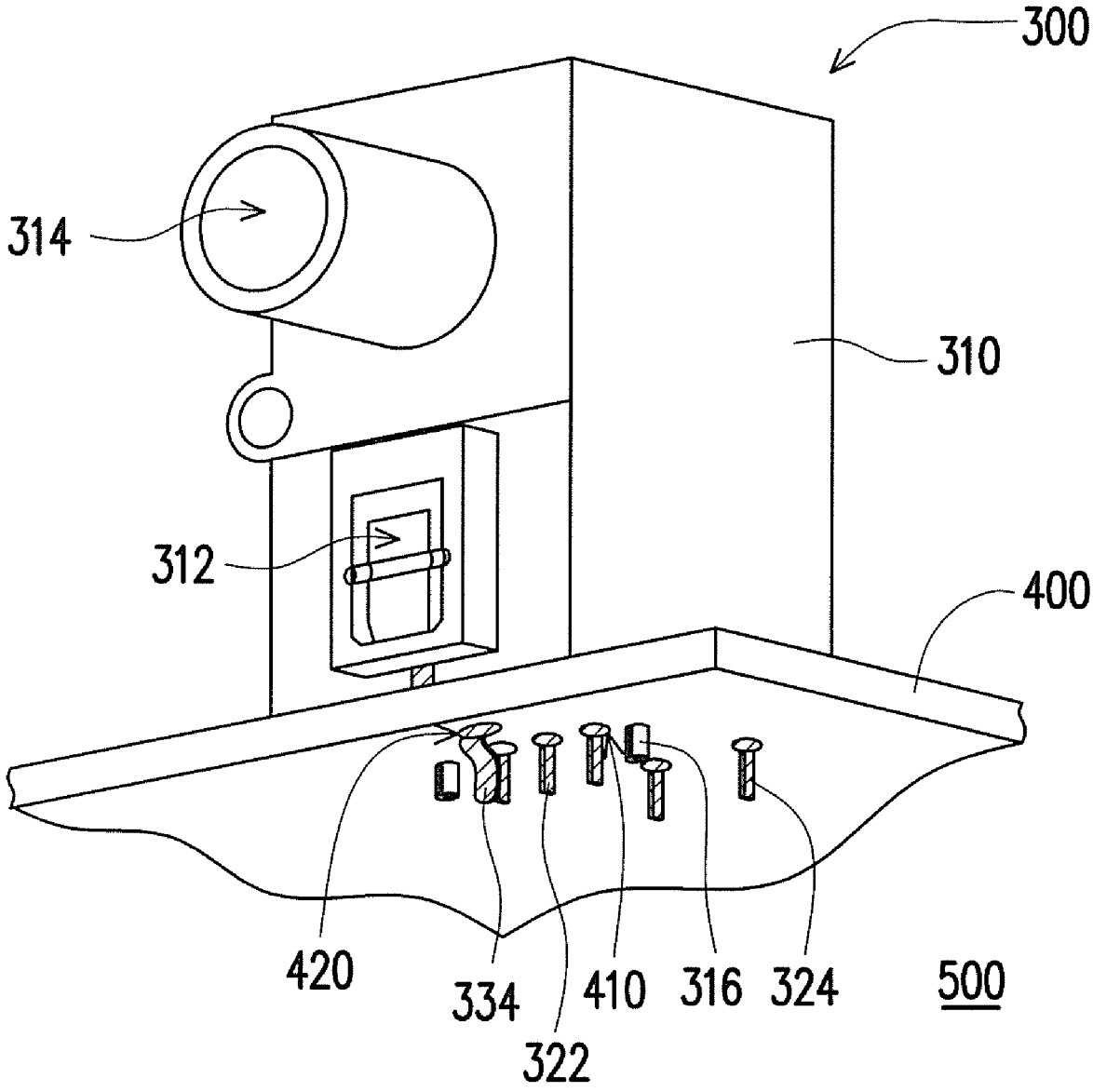
FIG. 3 is a schematic diagram illustrating a connector of FIG. 2 assembled on a circuit board.

FIG. 3 is a schematic diagram illustrating a connector of FIG. 2 assembled on a circuit board. As shown in FIG. 3, when the connector 300 is assembled to a circuit board 400 to form an electronic device 500, the portion of each signal terminal 320 protruding out from the insulating housing 310 is correspondingly inserted into a signal terminal through hole 410 of the circuit board 400, the first fixing part 334 of the metal fixing element 330 is correspondingly inserted into one of the fixing through holes 420 of the circuit board 400, and the second fixing parts 316 of the insulating housing 310 are correspondingly inserted into other fixing through holes 420 of the circuit board 400.

The connector 300 is assembled on the circuit board 400 via the first fixing part 334 of the metal fixing element 330, the second fixing part 316 of the insulating housing 310, and signal terminal through hole 410 and the fixing through holes 420 of the circuit board 400.

It should be noted that considering a stress distribution of the connector 300 when the connector 300 is assembled on the circuit board 400, the first fixing part 334 of the metal fixing element 330 is disposed at a side of the insulating housing 310 adjacent to an edge of the circuit board 400, and the second fixing parts 316 are disposed at a side of the insulating housing 310 departing from the edge of the circuit board 400. If the number of the first fixing part 334 is one, and the number of the second fixing part 316 is two, the first fixing part 334 and the second fixing parts 316 can be arranged in a shape similar to a triangle. If the number of the first fixing part 344 is two, and the number of the second fixing part 316 is also two, the first fixing parts 334 and the second fixing parts 316 can be respectively disposed at four corners of the insulating housing 310 of the connector 300.

Moreover, to prevent the connector 300 easily falling off the circuit board 400 after the connector 300 is assembled to the circuit board 400, the first fixing part 334 can be slightly bended, so that after the first fixing part 334 is inserted into the fixing through hole 420, the bended part of the first fixing part 334 can buckle the circuit board 400. Thus, the connector 300 cannot be easily fallen off the circuit 400.

Similarly, the second fixing part 316 can also be fabricated as a buckle structure that can buckle the circuit board 400, so as to assemble the connector 300 on the circuit board 400 via the second fixing parts 316. In the present embodiment, the second fixing part 316 has a guiding structure, for example, the edge of the second fixing part 316 has a shape of a harpoon. Base on such guiding structure, the second fixing parts 316 can be easily inserted into the fixing holes 420. Then, due to an elastic resilience and the shape of the second fixing part 316, the second fixing part 316 can buckle the circuit board 400. Therefore, the connector 300 can be prevented from falling off the circuit board 400 via the second fixing parts 316.

The number the second fixing parts 316, or usage or not of the second fixing parts 316 of the insulating housing 310 can be determined according to actual requirements. For example, a designer can determine to use only one metal fixing element 330 and a plurality of second fixing parts 316 or to use only a plurality of metal fixing parts 330 and none second fixing part 316 with reference of the cost of the metal fixing part 330 and the insulating housing 310.

Certainly, edge shapes of the first fixing part 334 and the second fixing parts 316 are only an example, and those skilled in the art can change the edge shapes of the first fixing part 334 and the second fixing parts 316 according to the related art, which can also prevent the connector 300 from falling off the circuit board 400.

Particularly, since the material of the metal fixing element 330 is copper, aluminum, aluminum ferroalloy, tin lead alloy, etc., the first fixing part 334 of the metal fixing element 330 can be welded on the circuit board 400. By welding the first fixing part 334 on the circuit board 400, when the electronic device 500 is carelessly collided during transportation, or during a drop test or an impact test is performed to the electronic device 500, though an impact stress on the first fixing part 334 located adjacent to the edge of the circuit board 400 is relatively great, the connector 300 can still be stably fixed on the circuit board 400 after the electronic device 500 is impacted since the connector 300 is welded on the circuit board 400 via the first fixing part 334 of the metal fixing element 330, and occurrence of the problem that the connector 300 is floated and leaned on the circuit board 400 can be avoided. Compared to the conventional technique, the connector 300 of the present embodiment is welded on the circuit board 400 via the first fixing part 334 of the metal fixing element 330, so that the connector 300 can be stably fixed on the circuit board 400, and accordingly the production yield and usage lifespan of the electronic device 500 can be improved.

Second Embodiment

The present embodiment is similar to the first embodiment, and like reference numerals refer to the like elements. Therefore, detailed description thereof is not repeated, and only differences thereof are described below.

Figure 4A:
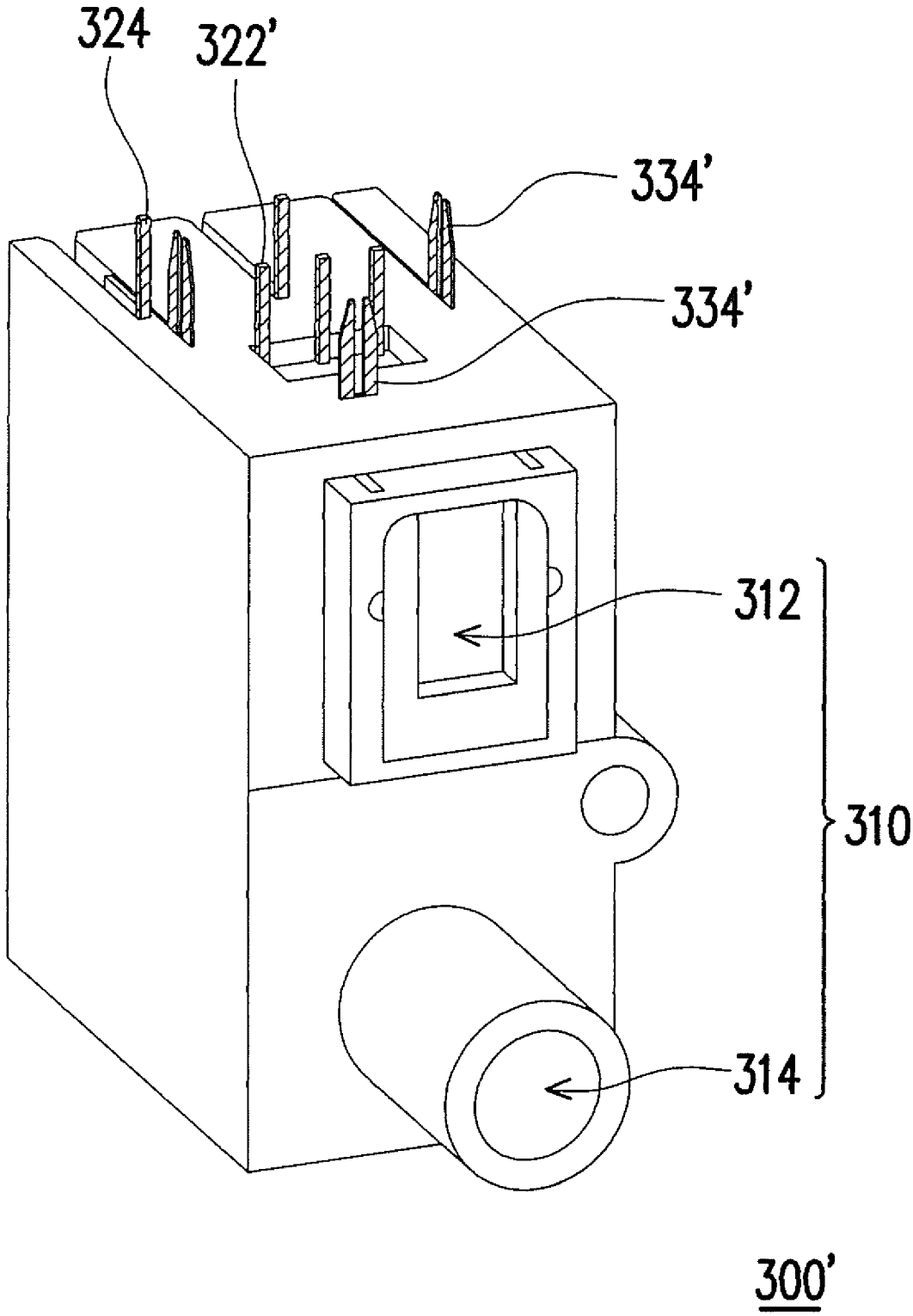
FIG. 4A is a schematic diagram illustrating a connector according to a second embodiment of the present invention.
Figure 4B:
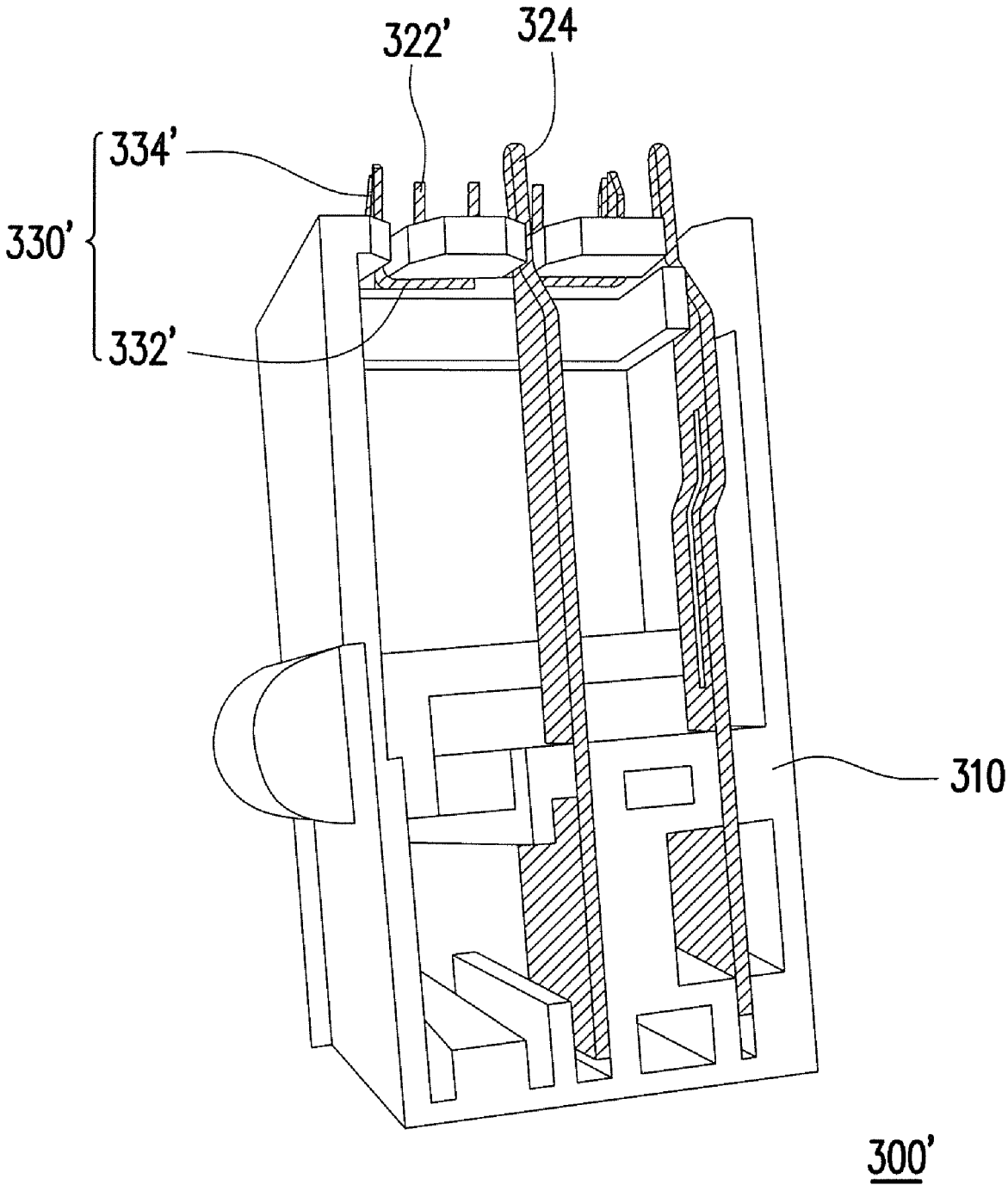
FIG. 4B is another view of the connector of FIG. 4A.

FIG. 4A is a schematic diagram illustrating a connector according to a second embodiment of the present invention, and FIG. 4B is another view of the connector of FIG. 4A. Referring to FIG. 4A and FIG. 4B, the connector 300' of the present embodiment has a plurality of the metal fixing elements 330', and none second fixing part is allocated on the insulating housing 310. Moreover, the inserting part 332' of each metal fixing element 330' is approximated perpendicular to the first fixing part 334'.

Referring to FIG. 3 and FIG. 4A again, to facilitate assembling the connector 300' to the circuit board 400, and prevent the connector 300' from falling off the circuit board 400, the shape of the first fixing part 334' of the metal fixing element 330' can also be a harpoon. Certainly, the shape of the first fixing part 334' of each metal fixing element 330' can also be designed according to actual requirements.

After the connector 300' is assembled on the circuit board 400, the first fixing part 334' of the metal fixing element 330' is welded on the circuit board 400, so as to avoid occurrence of the problem that the connector 300' is floated and leaned on the circuit board 400 when the electronic device (not shown) is impacted. By such means, the production yield of the electronic device can be ensured, and the usage lifespan of the electronic device can be prolonged.

Particularly, when the metal fixing element 330' is fabricated, the first signal terminal 322' can be formed integrally with the metal fixing element 330'. By such means, the first signal terminal 322' can be correspondingly connected to the first fixing part 334' via the inserting part 332' of the metal fixing element 330'.

When the connector 300' is assembled to the circuit board 400, the first signal terminal 322' and the first fixing part 332' of the metal fixing element 330' are all welded on the circuit board 400. If signal transmission quality between the first signal terminal 322' and the circuit board 400 is poor, the first fixing part 332' can be utilized for signal transmission.

In summary, the connector and the electronic device using the same of the present invention has at least the following advantages:

1. The connector is welded to the circuit board via the first fixing part of the metal fixing element, so that when the electronic device is collided during transportation, the connector can still be stably fixed on the circuit board without floating and leaning. Therefore, the connector and the circuit board can operate normally, and the production yield and the usage lifespan of the electronic device can be improved.

2. The number of the metal fixing elements can be determined according to the number of the second fixing parts disposed on the insulating housing, so as to save the cost thereof.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A connector, comprising:

an insulating housing, having at least one second fixing part;

a plurality of signal terminals, disposed in the insulating housing, wherein a portion of each signal terminal is protruding out from the insulating housing; and at least a metal fixing element, having an inserting part and a first fixing part connected to the inserting part, wherein the inserting part is inserted in the insulating housing, and the first fixing part is protruding out from the insulating housing at a same side with the signal terminals and has a bended part for buckling a circuit board, wherein the at least one second fixing part is arranged on the insulating housing at a same surface with that of the first fixing part of the metal fixing element, the first fixing part is located on a side of the insulating housing adjacent to an edge of the circuit board, and the second fixing parts are located at a side of the insulating housing departing from the edge of the circuit board.

2. The connector as claimed in claim 1, wherein the metal fixing element is formed by bending a resilient plate.

3. The connector as claimed in claim 1, wherein an edge of the first fixing part has a shape of a column or a harpoon.

4. The connector as claimed in claim 1, wherein material of the second fixing part is insulating material.

5. The connector as claimed in claim 1, wherein material of the second fixing part is metal material.

6. The connector as claimed in claim 1, wherein the first fixing part and the at least one second fixing part are arranged at edge of the surface of the insulating housing.

7. An electronic device, comprising:

a circuit board, having an edge on which a plurality of signal terminals through holes and a plurality of fixing through holes disposed;

a connector, disposed on the circuit board, comprising:

an insulating housing, having at least one fixing part correspondingly inserted in at least one of the fixing through holes;

a plurality of signal terminals, disposed in the insulating housing, wherein a portion of each signal terminal is protruding out from the insulating housing and is inserted in the corresponding signal terminal through hole; and at least a metal fixing element, having an inserting part and a first fixing part connected to the inserting part, wherein the inserting part is inserted in the insulating housing, and the first fixing part is protruding out from the insulating housing at a same side with the signal terminals, correspondingly inserted in at least one of the fixing through holes, and has a bended part for buckling the circuit board, wherein the at least one second fixing part is arranged on the insulating housing at a same surface with that of the first fixing part of the metal fixing element, the first fixing part is located on a side of the insulating housing adjacent to an edge of the circuit board, and the second fixing parts are located at a side of the insulating housing departing from the edge of the circuit board.

8. The electronic device as claimed in claim 7, wherein the metal fixing element is formed by bending a resilient plate.

9. The electronic device as claimed in claim 7, wherein an edge of the first fixing part has a shape of a column or a harpoon.

10. The electronic device as claimed in claim 7, wherein material of the metal fixing element is aluminum ferroalloy or tin alloy.

* * * * *